US008643685B2

(12) United States Patent
McGuire et al.

(10) Patent No.: US 8,643,685 B2
(45) Date of Patent: Feb. 4, 2014

(54) PHOTORECEPTOR WITH A TFT BACKPLANE FOR XEROGRAPHY WITHOUT A ROS SYSTEM

(75) Inventors: Gregory McGuire, Oakville (CA); Vladislav Skorokhod, Mississauga (CA); Robert A. Street, Palo Alto, CA (US)

(73) Assignee: Xerox Corporation, Norwalk, CT (US)

( * ) Notice: Subject to any disclaimer, the term of this patent is extended or adjusted under 35 U.S.C. 154(b) by 865 days.

(21) Appl. No.: 12/366,665

(22) Filed: Feb. 6, 2009

(65) Prior Publication Data

US 2010/0201612 A1 Aug. 12, 2010

(51) Int. Cl.
*B41J 2/39* (2006.01)
*B41J 2/395* (2006.01)

(52) U.S. Cl.
USPC ..... 347/141

(58) Field of Classification Search
USPC ..... 347/141
See application file for complete search history.

(56) References Cited

U.S. PATENT DOCUMENTS

| | | | | |
|---|---|---|---|---|
| 5,426,488 | A * | 6/1995 | Hayakawa et al. | 399/174 |
| 6,100,909 | A | 8/2000 | Haas et al. | |
| 2005/0259140 | A1 * | 11/2005 | Kim et al. | 347/140 |
| 2008/0292341 | A1 * | 11/2008 | Yamamoto | 399/51 |

* cited by examiner

*Primary Examiner* — Ryan Lepisto
*Assistant Examiner* — Erin Chiem
(74) *Attorney, Agent, or Firm* — Fay Sharpe LLP

(57) ABSTRACT

Systems and methods are described that facilitate eliminating a need for a raster output scanner (ROS) or laser when generating a latent image on a photoreceptor. An addressable backplane is employed, comprising an array of field effect transistors (e.g., silicon or organic thin film transistors, or TFTs), wherein each TFT corresponds to a single pixel on a charge transport layer on the photoreceptor surface. Latent image formation is performed by forming a surface potential using corona charging, and then directing free charge carriers toward the photoreceptor surface to reduce electrostatic potential in areas that need to be toned. TFTs in the array are individually addressed, or selected, to connect to a common ground, which allows photodischarge to occur only in selected areas (e.g., pixels associated with the selected TFTs). Once the array of TFTs is addressed, an LED light source emits light over the surface of the photoreceptor, and only the selected (grounded) TFTs permit their associated pixels to discharge. In this manner, a latent image is formed without a need for a bulky and expensive ROS.

13 Claims, 5 Drawing Sheets

PHOTORECEPTOR WITH A TFT BACKPLANE FOR XEROGRAPHY WITHOUT A ROS SYSTEM

CROSS-REFERENCE TO RELATED APPLICATIONS

The subject application contains subject matter related to U.S. patent application Ser. No. 12/366,680, entitled "IMAGE FORMING APPARATUS WITH A TFT BACKPLANE FOR XEROGRAPHY WITHOUT A LIGHT SOURCE," and filed concurrently herewith, the entirety of which is incorporated by reference herein.

BACKGROUND

The subject application relates to latent image formation in xerographic systems. While the systems and methods described herein relate to image formation in xerographic systems, it will be appreciated that the described techniques may find application in other image formation systems, other xerographic applications, and/or other imaging methods.

Approaches to photoreceptor-based xerography have included using high-mobility transport layers, light-absorbing additives, anti-reflective substrates, and addressable LED or LCD light sources.

Classical latent image formation in xerography consists of the following steps: charging the surface of the imaging member (e.g., a photoreceptor) with corona to create background surface potential; photo-generating free charge carriers within the areas that need to be toned; and changing surface potential in these areas by transporting photo-generated charge towards the surface.

In analog or light-lens xerography, using the light reflected from the original image to photo-generate electric charge in a photosensitive imaging member is the conventional way to convert an original image into a latent image. In digital xerography, however, the original image is already digitally encoded, and therefore can be converted into various types of signal. The concept of using light to write a latent image onto a photosensitive imaging member was simply inherited from light-lens xerography, but it is not the only possible way to generate a latent image.

Disadvantages of photoreceptor-based xerography include low charge mobility, sensitivity to light shock, and the need of an expensive light source such as a raster output scanner (ROS) (e.g., a laser) that occupies a considerable space in the system and adds greatly to its cost. Additionally, exposure to a laser beam is associated with various parasitic effects that cause image distortion and limit resolution (see, e.g., Journal of Imaging Sci. and Tech, vol. 40, p. 327, 1996)

U.S. Pat. No. 6,100,909 (Haas and Kubby) describes an apparatus for forming an imaging member comprising an array of high voltage thin-film transistors (TFT) and capacitors. A latent image directly formed by applying appropriate DC bias to the TFT using a high-voltage power supply (HVPS) and charged-area detection (CAD)-type development.

Accordingly, there is an unmet need for systems and/or methods that facilitate using photodischarge for surface potential reduction and TFT control for latent image formation on an imaging member, while overcoming the aforementioned deficiencies.

BRIEF DESCRIPTION

In accordance with various aspects described herein, systems and methods are described that facilitate forming a latent image on a photoreceptor without a raster output scanner. For example, a method of forming a latent image on a photoreceptor comprises addressing pixels on a charge transport layer by applying a gate-to-source voltage (Vgs) that is greater than a predetermined threshold voltage (Vth) to one or more thin-film transistors (TFTs) coupled to one or more respective latent image pixels, and applying a gate-to-source voltage (Vgs) of 0V to one or more TFTs coupled to one or more background pixels. The method further comprises charging the charge transport layer, which is coupled to a TFT array comprising the one or more TFTs on the photoreceptor by a charge generation layer, applying light to the charge transfer layer to photodischarge the one or more latent image pixels, and performing a discharged area development (DAD) technique on the charge transfer layer to develop the latent image on a print medium.

According to another feature described herein, a system that facilitates forming a latent image on a photoreceptor comprises a thin-film transistor (TFT) array comprising a plurality of TFTs coupled to a ground plane, a charge generation layer deposited over the TFT array, a charge transport layer deposited over the charge generation layer, and a light source that applies light to the photoreceptor to photodischarge one or more pixels on the charge transport layer. Each TFT corresponds to a pixel the charge transport layer. The charge transport layer is charged with negative ions. The TFTs have a gate-to-source voltage (Vgs) that is adjustable to allow photodischarge of respective pixels coupled to the respective TFTs to form a latent image.

Yet another feature relates to a method of forming a latent image on a photoreceptor, without a raster output scanner, comprising using thin-film transistors (TFT) with an adjustable gate-to-source voltage to permit photodischarge of ions from pixel regions on a charge transport layer, and corona charging the charge transfer layer. The method further comprises applying light to photodischarge pixels coupled to TFTs with a gate-to-source voltage (Vgs) greater than a predetermined threshold voltage (Vth), and developing a latent image formed by discharged pixel regions on the charge transport layer using a discharged area development (DAD) technique.

DETAILED DESCRIPTION

In accordance with various features described herein, systems and methods are described that facilitate using a TFT backplane with discharged area development (DAD) for latent image formation (e.g., whereby discharged area(s) on the imaging member surface correspond to an image on a print medium, and charged areas correspond to background). The described systems and methods facilitate forming latent images without the direct coupling of a high-voltage power source (HVPS) to the surface of the imaging member.

The described innovation eliminates a need for a raster output scanner (ROS) or laser when generating a latent image on a photoreceptor. The innovation employs a light emitting diode (LED) light source to charge a charge transport layer on a photoreceptor, and an addressable backplane comprising an array of field effect transistors (e.g., silicon or organic thin film transistors, or TFTs), wherein each TFT corresponds to a single pixel on the photoreceptor surface. Latent image formation is performed by forming a surface potential using corona charging, and then directing free charge carriers toward the photoreceptor surface to reduce electrostatic potential in areas that need to be toned. The array (backplane) of TFTs in the photoreceptor are individually addressed or selected to connect to a common ground, which allows photodischarge to occur only in selected areas (e.g., pixels associated with the selected TFTs). Once the array of TFTs is addressed, the LED light source emits light over the surface of the photoreceptor, and only the selected (grounded) TFTs permit their associated pixels to discharge. In this manner, a latent image is formed without a need for a bulky and expensive ROS.

Figure 1:
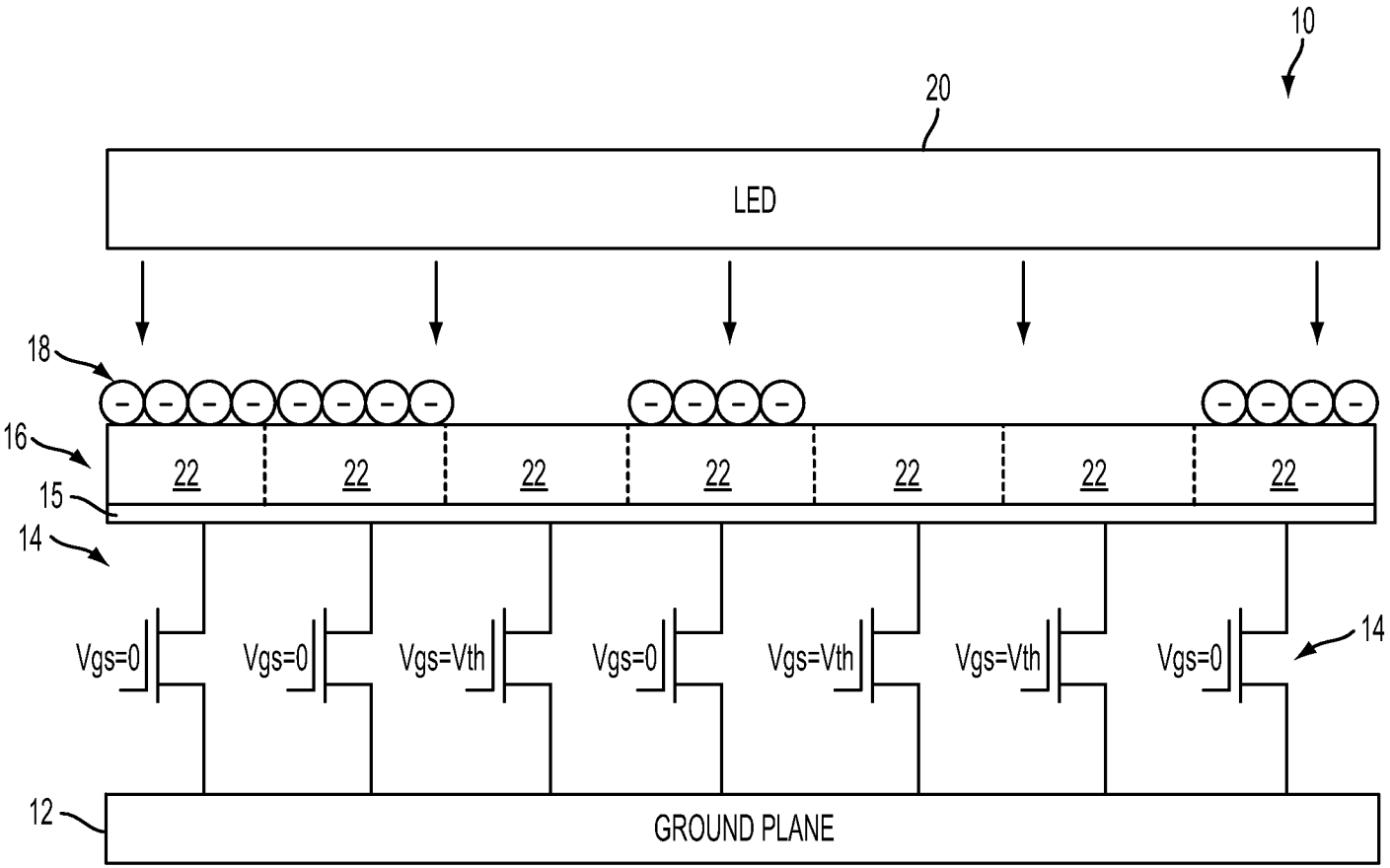
FIG. 1 illustrates a latent image forming system that facilitates latent image formation on a surface of an imaging member using a thin-film transistor (TFT) backplane comprising a plurality of TFTs, which are also coupled to a charge (e.g., hole) transport layer via a charge generation layer.

With reference to FIG. 1, a latent image forming system 10 that facilitates latent image formation on a surface of an imaging member using a TFT backplane comprising a plurality of TFTs 14 with the source electrodes connected to ground plane 12, and drain electrodes also coupled to a charge (e.g., hole) generation layer 15. A charge (e.g., hole) transport layer 16 is overlaid on the charge generation layer 15. The system 10 uses photodischarge for surface potential reduction and TFT control for latent image formation. Corona charging is employed to fully charge the charge transport layer 16 with charged particles 18. Some of the charged areas of the charge transport layer 16 are then partially or fully discharged by adjusting a voltage across one or more TFTs 14 located underneath said areas and applying light from an LED source 20. For instance TFTs with a gate-to-source voltage (Vgs) of 0 will not allow electron counter-charge (e.g., charge of the opposite polarity) to be transported between the charge generation layer 15 and the ground electrode 12, thus preventing discharging of areas of the charge acceptance layer 16 in the vicinity of such TFTs when exposed to light. Other TFTs with a Vgs greater than a predetermined threshold voltage (Vth) allow counter-charge to be transported from the charge generation layer 15 to the ground plane 12 and thus allow discharge of the surface of the charge transportation layer 16 in their vicinity upon exposure to light to form a latent image. The resolution of the latent image is limited only by the manufacturing capability of printed TFTs. For example, the image resolution may be 600 dpi or greater.

The TFTs 14 may be organic or silicon-based, and a photosensitive device and a light source are not required for latent image generation. In one embodiment, each TFT element corresponds to an individual pixel 22 (e.g., an area or region of the charge transport layer 16 with a surface area equal to one image pixel).

When forming a latent image, the charge transport layer 16 is charged using a corona device (not shown). In one embodiment, the corona device is a scorotron. In another embodiment, a biased roll charging device (not shown) is used to charge the charge transport layer, such as is known by those of skill.

A scorotron is a device that charges the charge transport layer 16 using one or more corona-producing wires. Between the corona-producing wires and the surface being e charged is a grid of wires. The corona emitting wires are maintained at a high voltage that maintains the wire grid at a desired surface-charging potential. Initially, the charge transport layer has a potential lower than desired, causing corona current to pass through the wire grid to the charge transport layer. When the charge transport layer potential and the wire grid potential are equal, corona current flow to the charge transport layer is terminated.

Corona current is current that flows towards a corona wire when the wire is maintained at a high potential relative to ground (e.g., a corona threshold voltage, Vth). Gas molecules (e.g., air) around the wire are ionized by the high potential, and the electrons move towards the corona wire, colliding with other gas molecules along the way to cause additional ionization. The ionized gas molecules flow away from the corona wire and form a positive current that is used to charge the charge transport layer 16. Vth is the voltage at or above which a corona appears around the corona wire, due to gas molecule ionization.

The areas of a latent image that need to be toned are selected by applying a Vgs>Vth to the appropriate TFT elements, while Vgs=0 is applied to the TFTs within the background areas. Charging the surface of the transport layer is then performed using a corona charging device (not shown). The charge transport layer, when charged, creates a background potential (Vbg) as well as a bias between drain and source (ground) electrodes on the TFTs. A light source (e.g., monochromatic LED bar or light 20) then bathes the charge transport layer on the photoreceptor to induce photogeneration. Only areas with Vgs>Vth undergo photodischarge, thereby forming the latent image. The latent image may then be developed using a discharged area development (DAD) technique.

The proposed concept offers the following advantages over traditional photoreceptor xerography: elimination of the ROS system, which increases imaging process reliability, reduces noise, improves resolution, and reduces system size; enables a purely digital functionality with a fixed resolution; and long term cost advantage.

In one embodiment, the TFTs 14 have a 1:1 ratio with pixel electrodes 22 on the charge transport layer 16 (e.g., each pixel has a dedicated TFT to control whether it is charged or discharged during photogeneration). In another example, the TFTs have a ratio greater than 1:1 with the pixels 22, for enhanced resolution.

Figure 2:
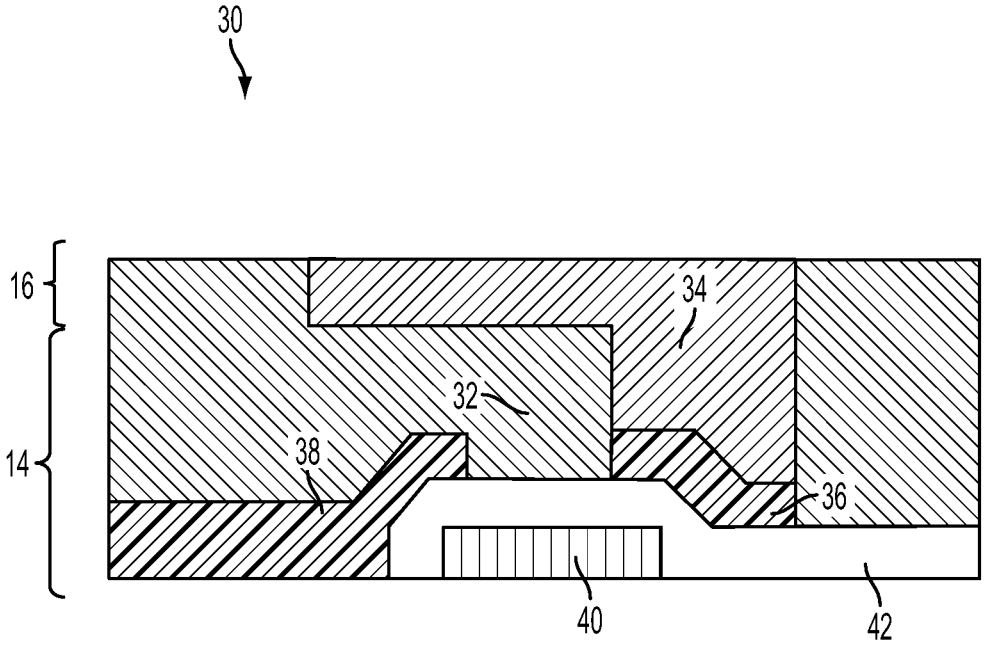
FIG. 2 illustrates a cross-section view of a single pixel of a TFT backplane device, which includes a TFT and ground plane, in accordance with various aspects described herein.

FIG. 2 illustrates a cross-section view of a single pixel of a TFT backplane 30 device, which includes a TFT 14 shown in FIG. 1, in accordance with various aspects described herein. The TFT backplane 30 includes a TFT 14 that comprises semiconductor material 32 (e.g., organic or inorganic) and polymer-filler composite 34 that is coupled to a drain electrode 36 that contacts the charge generation layer 15 for the imaging member. A source 38 is permanently connected to a ground electrode 12 (in FIG. 1). To tone a pixel, a voltage (Vgs) is applied to a gate electrode 40 by addressing it from the inner side of the device, which connects the drain electrode 36 to a common ground, allowing photodischarge to occur. The gate electrode 40 is coupled to a data driver (see FIG. 3) and to a gate dielectric layer 42, which in turn is coupled to the remainder of the TFT 14 (e.g., the drain 36 electrode, source or ground electrode 38, and the semiconductor material 32).

In one embodiment, the drain 36 is electrostatically coupled to the surface of a scorotron (not shown) used to charge the charge transport layer of the imaging member on which the TFT backplane device 30 is employed, in order to supply charge thereto. Opening the transistor lets charge flow through the TFT to cancel charge from the scorotron, permitting the expulsion of ions therefrom (e.g., discharge) during photodischarge.

The TFT backplane section shown in FIG. 2 is based on horizontal TFT. Additionally or alternatively, a vertical TFT design can be used. A guard electrode (not shown) may be introduced to prevent cross-talk between the TFT elements.

According to an example, substrate (e.g., ground plane 16) is provided with an array of TFTs 14. To form the TFTs, amorphous silicon or organic transistors are made by photolithography with a sputtered metal gate contact 40 followed by a silicon nitride gate dielectric 42 and an amorphous silicon channel, both deposited by plasma-enhanced chemical vapor deposition (CVD). This is followed by n-type doped amorphous silicon for the source contact 38 and drain contact 36, and then a metal interconnect layer. A silicon oxynitride passivation may be formed layer over the top of the TFT. The source column electrodes are connected to a common ground and to gate electrodes connected to a gate driver. The drain electrodes 36 act as a high resolution switchable ground plane for the imaging member.

Upon the drain electrodes, the charge generating layer 15 (FIG. 1) is deposited. In one example, the charge generating layer 15 comprises the photosensitive pigment HOGaPc and the binder polymer PCZ-200 in approximately a 1:1 ratio, and 5.5% solids dispersed in THF. The layer is deposited using common solution web coating methods and dried in a forced air oven at 100° C. for 5 minutes.

Upon the charge generating layer 15, the charge transport layer 16 (FIG. 1) is deposited. The charge transport layer comprises 50% N,N'-diphenyl-N,N-bis(3-methylphenyl)-1,1'-biphenyl-4,4'-diamine and 50% Makrolon™ and is 15% solids in $CH_2CL_2$. The layer is deposited using common solution web coating methods and dried in a forced air oven at, for example, 100° C. for 5 minutes.

Selected TFTs under areas to be toned are switched "on" by applying Vgs>Vth to gate electrodes 40, which causes the drain electrodes 36 to be grounded. Meanwhile, TFTs under background areas are switched "off" by applying Vgs=0 to the gate electrodes 40, leaving them floating. In this manner, a pre-latent image is formed on the array of TFTs. A scorotron device is then used to charge the surface of the device to a set potential there across. The LED bar light source 20 (FIG. 1) is passed over the device inducing photodischarge only over the TFT drain electrodes that are switched "on". In this manner a latent image is formed on the surface of the imaging member and is ready to be toned.

According to another example, the TFTs described herein operate at a threshold voltage (Vth) of approximately 40V. TFTs are modified to withstand several hundred Volts (e.g., 200V-800V, in one example), while operating at 40V, by spacing the drain 36 and source 38 so that voltage is attenuated and the applied voltage is approximately 40V.

Figure 3:
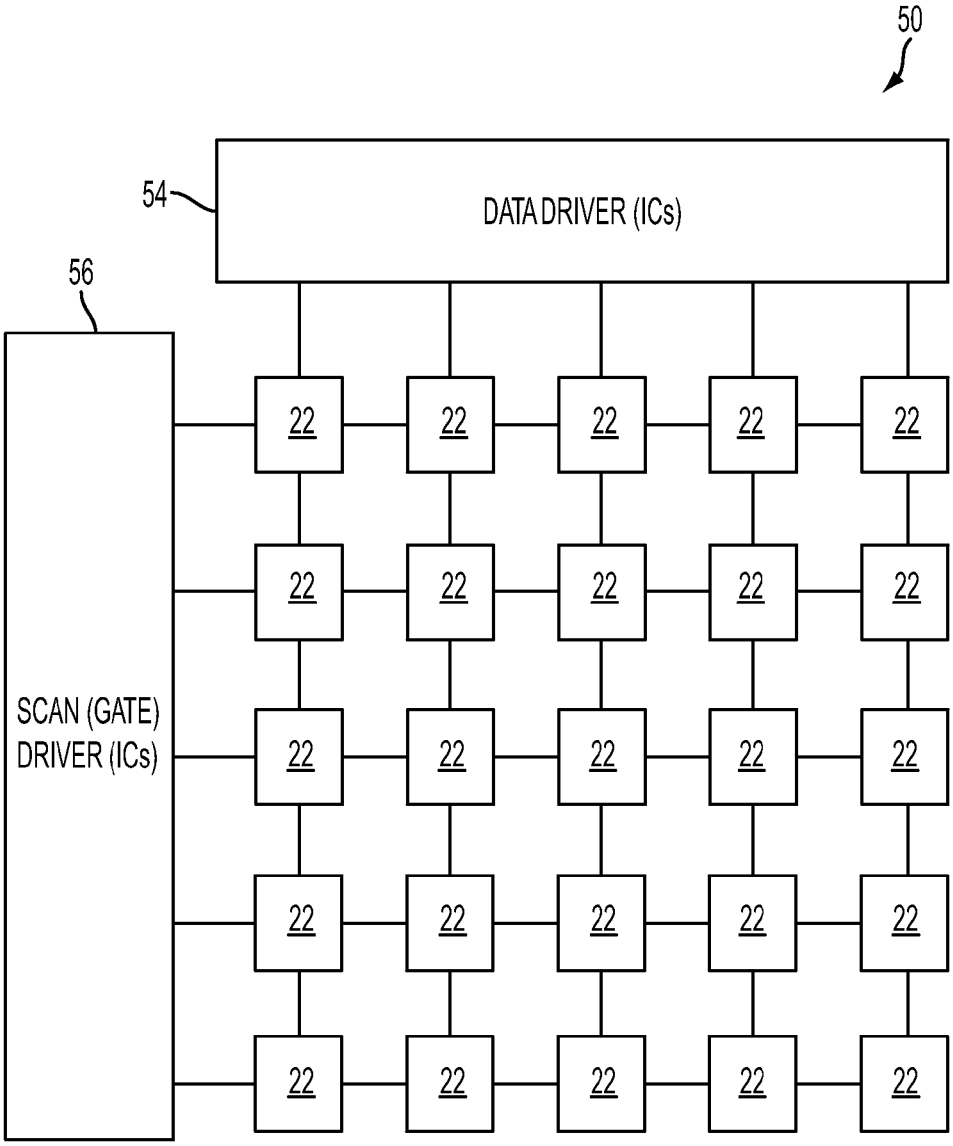
FIG. 3 illustrates an array of pixel electrodes that uses an active matrix driving scheme in which a plurality of pixel electrodes are each connected to a switching device (TFT) as described herein.

FIG. 3 illustrates an array 50 of pixel electrodes 22 (also called a TFT array herein) that uses an active matrix driving scheme in which a plurality of pixel electrodes are each connected to a switching device (TFT) as described herein. An active substrate of an imaging device employing the array 50 contains a plurality of column (data) electrodes that are coupled to a data driver 54 (e.g., one or more integrated circuits or ICs), limited by the number of pixels 22 per row, and a plurality of row (scan) electrodes coupled to a scan driver 56 (e.g., one or more ICs), limited by the number of pixels per column. The scan electrodes control the gates of respective TFTs. Each switching TFT (coupled to the respective pixel electrodes) has a control (gate) terminal connected to the scan electrode, an input (source) terminal connected to the data electrode and an output (drain) terminal connected to a charge transport layer of the photoreceptor.

In one embodiment, two TFTs are provided per pixel, where a first TFT controls the gate of a second TFT to address a row of pixels (e.g., to hold the pixels open). A pattern on "ON" and/or "OFF" TFTs is written line by line.

According to an example, "select" voltages (e.g., Vgs>Vth) are applied to the gates of a first row of the TFTs while non-select voltages are applied to the TFT gates in all other pixel rows. A light source (LED for example) is used to photodischarge the surface potential. Only TFTs with select voltages will allow photodischarge. The select voltage applied to the gates in the first row of TFTs is then charged to a "non-select" voltage (e.g., Vgs=0). This sequence is repeated for each succeeding row until all of the rows have been selected and the desired pixels have been discharged to form a latent image on the imaging device surface. After discharge area development, select voltages are applied to all row (gate) electrodes simultaneously to clear the latent image.

In another embodiment, to operate in a continuous mode with development and erase, a dual scanning mode may be implemented. The array 50 is divided into two equal halves, and separate data and scan drivers are used for each of the two half-arrays. When one half of the array is completely past the discharge area development stage, that half-array can be activated all at once to clear the partial latent image. Concurrently, the other half array can begin addressing its pixels to form the remainder of the latent image. This process can be repeated to obtain continuous mode printing.

Figure 4:
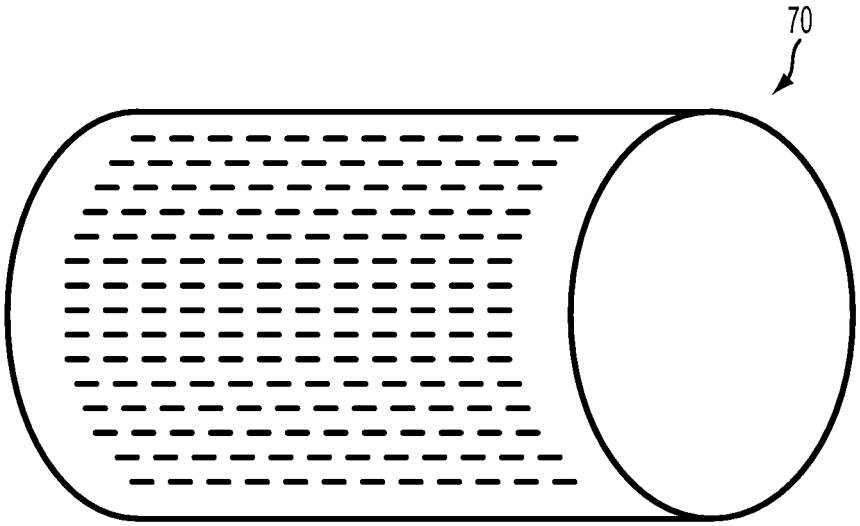
FIGS. 4 and 5 illustrate a latent image of surface charge using conventional row-by-row addressing of pixels to create the latent image of surface charge.
Figure 5:
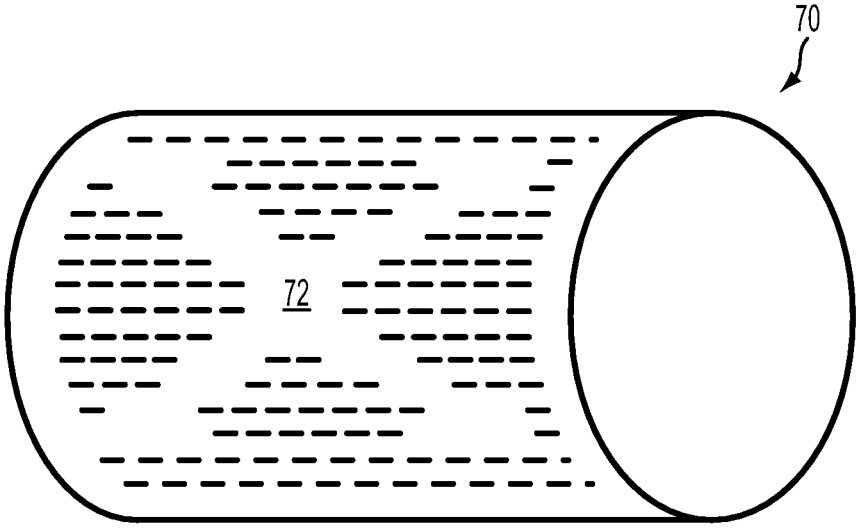

FIGS. 4 and 5 illustrate a latent image of surface charge using conventional row-by-row addressing of pixels to create the latent image of surface charge. In FIG. 4, an imaging member 70 having a layer of the TFT backplane described herein that is charged using a scorotron (not shown) or the like. In FIG. 5, a latent image 72 is formed on the imaging member by discharging areas corresponding to the latent image 72. For instance, individual pixels are addressed row-by-row to form the latent image 72, followed by discharge area development.

Figure 6:
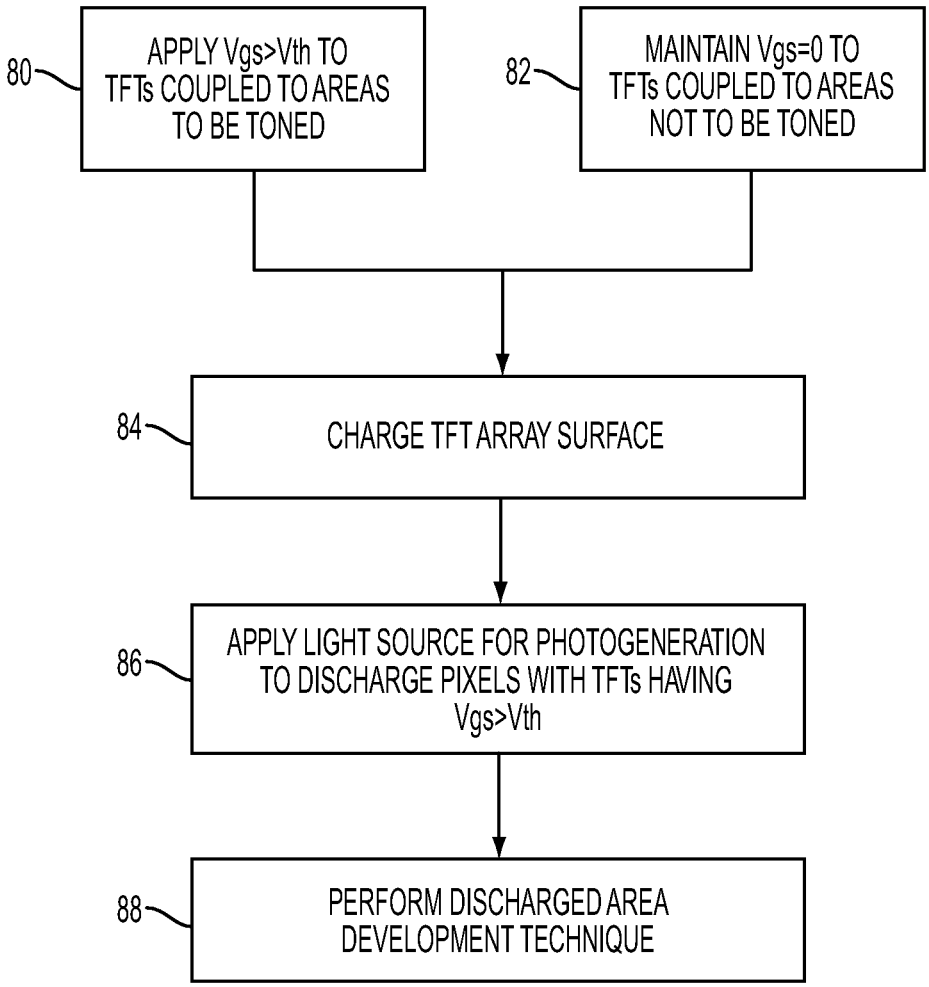
FIG. 6 illustrates a method of latent image formation, in accordance with various aspects presented herein.

FIG. 6 illustrates a method of latent image formation, in accordance with various aspects presented herein. At 80, areas to be toned (e.g., to which toner is to adhere) are discharged by supplying free charge carriers (holes) by applying gate-to-source voltage Vgs that is greater than Vth to appropriate TFT elements in a TFT array. Concurrently, at 82, a voltage Vgs=0 is maintained for the TFTs within the background areas (e.g., areas not to be toned). At 84, a charge transport layer of the TFT array is charged using a corona device. The surface charge layer creates a background potential (Vbg) as well as a bias between the drain and source (ground) electrodes. At 86, a light source is applied to induce photogeneration, whereby pixel regions on the charge transport layer having TFTs with Vgs>Vth are discharged to form a latent image. At 88, a discharge area development technique is performed to develop a physical image from the latent image.

According to an example, a production photoreceptor comprising a mylar substrate, a TiZr metalized layer on top of the substrate, and a N,N'-diphenyl-N,N-bis(3-methylphenyl)-1,1'-biphenyl-4,4'-diamine and 50% Makrolon™ charge transport layer (e.g., the charge transport layer 16 of FIG. 1) is overlaid on top of a photo-generating layer. The metalized TiZr backplane is switched between grounded and floating states. The device was then charged with, for instance, a 4200 Volt Scorotron, and surface charge may be measured with a capacitance probe. In this example, the charge transport layer shows a high level of charge acceptance when the backplane is floating. Very little discharge occurs when exposed to light if the backplane is in a floating state, and full discharge occurs upon exposure to light if the backplane is in a grounded state. Thus, a TFT-switchable ground plane, such as is described herein with regard to the various described embodiments, facilitates inducing selective photodischarge of the surface potential, and latent image formation.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A system that facilitates forming a latent image on a photoreceptor, comprising:

a thin-film transistor (TFT) array comprising a plurality of TFTs coupled to a ground plane;

a charge generation layer deposited over the TFT array;

a charge transport layer deposited over the charge generation layer; and a light source that applies light to the photoreceptor to photodischarge one or more pixels on the charge transport layer;

wherein each TFT corresponds to a pixel of the charge transport layer;

wherein the charge transport layer is charged with negative ions; and wherein the TFTs have a gate-to-source voltage (Vgs) that is adjustable to allow photodischarge of respective pixels coupled to the respective TFTs to form a latent image; and wherein one or more pixels is photodischarged to form the latent image on the charge transport layer by adjusting the gate-to-source voltage (Vgs) of one or more TFTs corresponding to the one or more pixels such that Vgs is greater than a predetermined threshold voltage (Vth), prior to application of light by the light source, wherein the voltage (Vgs) is applied to a gate electrode of respective TFTs by addressing the gate electrode from the inner side of the TFT;

wherein the TFTs are configured to withstand a range of approximately 200V to 800V, while operating at the predetermined threshold voltage, by spacing the drain and source to attenuate the applied voltage down to the predetermined threshold voltage.

2. The system of claim 1, further comprising a data driver that is coupled to a plurality of data electrodes, wherein each data electrode is coupled to source terminals on a plurality of TFTs in a respective column of the TFT array.

3. The system of claim 2, further comprising a scan driver that is coupled to a plurality of scan electrodes, wherein each scan electrode is coupled to gate terminals on a plurality of TFTs in a respective row of the TFT array.

4. The system of claim 3, wherein the charge transport layer is coupled to a drain terminal on the TFTs in the array.

5. The system of claim 1, further comprising at least one of a scorotron and a biased roll charging device that charges the charge transport layer.

6. The system of claim 5, wherein the TFTs have a gate-to-source voltage (Vgs) of 0V when the pixels are charged.

7. The system of claim 1, wherein the predetermined threshold voltage is approximately 40V.

8. The system of claim 1, wherein the charge transport layer comprises N,N'-diphenyl-N,N-bis(3-methylphenyl)-1,1'-biphenyl-4,4'-diamine and Makrolon™ in a ratio of approximately 2:3 to approximately 3:2.

9. The system of claim 8, wherein the charge transport layer is deposited on the TFT array using a solution web coating method, and dried in a forced air oven at approximately 100° C. for approximately 5 minutes.

10. The system of claim 1, wherein the charge transport layer comprises N,N'-diphenyl-N,N-bis(3-methylphenyl)-1,1'-biphenyl-4,4'-diamine and Makrolon™ in a ratio of approximately 1:1.

11. The system of claim 1, wherein the latent image is developed using a discharged area development (DAD) technique.

12. The system of claim 1, wherein the charge generating layer comprises a photosensitive pigment HOGaPc and a binder polymer PCZ-200 in approximately a 1:1 ratio, and is deposited using a solution web coating technique and dried in a forced air oven at approximately 100° C. for approximately 5 minutes.

13. The system of claim 1, wherein the light source is a light emitting diode (LED) bar light.

* * * * *